US008320812B2

(12) United States Patent
Kanno

(10) Patent No.: US 8,320,812 B2
(45) Date of Patent: Nov. 27, 2012

(54) IMAGE FORMING APPARATUS FOR ADDING GLOSS TO IMAGE FORMED ON RECORDING PAPER

(75) Inventor: Satoru Kanno, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 12/947,638

(22) Filed: Nov. 16, 2010

(65) Prior Publication Data

US 2011/0142511 A1 Jun. 16, 2011

(30) Foreign Application Priority Data

Dec. 16, 2009 (JP) ..... 2009-285754

(51) Int. Cl.
*G03G 15/20* (2006.01)

(52) U.S. Cl. ..... 399/341

(58) Field of Classification Search ..... 399/81, 399/320, 328, 341; 219/216; 347/212; 430/124.13, 430/124.2

See application file for complete search history.

(56) References Cited

U.S. PATENT DOCUMENTS

| | | | | |
|---|---|---|---|---|
| 5,751,432 | A * | 5/1998 | Gwaltney | 358/296 |
| 7,434,926 | B2 * | 10/2008 | Kusunoki | 347/102 |
| 2004/0169710 | A1 * | 9/2004 | Ide et al. | 347/101 |
| 2011/0103855 | A1 * | 5/2011 | Morikawa | 399/341 |

FOREIGN PATENT DOCUMENTS

| | | | | |
|---|---|---|---|---|
| JP | 63-192068 | A | | 8/1988 |
| JP | 09251251 | A | * | 9/1997 |
| JP | 2006163277 | A | * | 6/2006 |
| JP | 2007-052175 | A | | 3/2007 |
| JP | 2007052177 | A | * | 3/2007 |
| JP | 2007065459 | A | * | 3/2007 |
| JP | 2007256539 | A | * | 10/2007 |

* cited by examiner

*Primary Examiner* — Robert Beatty

(74) *Attorney, Agent, or Firm* — Canon USA, Inc., IP Division

(57) ABSTRACT

Provided is an image forming apparatus that includes a paper feeding unit configured to feed recording paper, a transfer unit configured to transfer a toner image to the recording paper fed by the paper feeding unit, a fixing unit configured to fix the toner image transferred to the recording paper by the transfer unit on the recording paper, a thermal head having a plurality of heating units arrayed in a width direction orthogonal to a conveying direction of the recording paper, and configured to add gloss by heating an arbitrary area of the recording paper on which the toner image has been fixed by the fixing unit for each line, a setting unit configured to set a gloss addition area in the recording paper to which the gloss is added by the thermal head, a correction unit configured to correct the gloss addition area set by the setting unit so that numbers of heating units driven when the recording paper is heated by the thermal head are approximately equal in each line, and a control unit configured to control driving of the plurality of heating units based on the gloss addition area corrected by the correction unit.

3 Claims, 9 Drawing Sheets

· W1+W2+W3+W4+W5=W9

· W6 + W7 + W8 =W9

IMAGE FORMING APPARATUS FOR ADDING GLOSS TO IMAGE FORMED ON RECORDING PAPER

BACKGROUND OF THE INVENTION

1. Field of the Invention

The present invention relates to an image forming apparatus such as a copying machine or a printer, and more particularly to an image forming apparatus that adds gloss to an image formed on recording paper.

2. Description of the Related Art

As a conventional electrophotographic image forming apparatus, for example, there has been proposed a method for adding gloss to recording paper by disposing a second fixing device on a downstream side of a first fixing device and heating the recording paper passing through the first fixing device again at the second fixing device (as discussed in Japanese Patent Application Laid-Open No. 63-192068).

However, this method can only add gloss to a whole surface of the recording paper and not in just a limited area. In addition, the method adds heat even to a portion that requires no gloss addition, and hence a problem of increased power consumption is created.

Thus, there has bee proposed a method for adding gloss to the recording paper only in a limited area by disposing a thermal head as the second fixing device on the downstream side of the first fixing device and heating an arbitrary area of the recording paper again by the thermal head (as discussed in Japanese Patent Application Laid-Open No. 2007-52175).

However, when gloss is added to the recording paper by using the thermal head, a sudden change in a number of heating units of the thermal head to be powered-on causes fluctuation in voltage applied to the thermal head. As a result, a heat generation amount of the thermal head fluctuates. In such a case, uneven brightness occurs on the recording paper, causing deterioration of image quality.

SUMMARY OF THE INVENTION

The present invention is directed to an image forming apparatus that can prevent uneven brightness on recording paper by suppressing fluctuation in voltage applied to a thermal head.

According to an aspect of the present invention, an image forming apparatus includes a paper feeding unit configured to feed recording paper, a transfer unit configured to transfer a toner image to the recording paper fed by the paper feeding unit, a fixing unit configured to fix the toner image transferred to the recording paper by the transfer unit on the recording paper, a thermal head having a plurality of heating units arrayed in a width direction orthogonal to a conveying direction of the recording paper, and configured to add gloss by heating an arbitrary area of the recording paper on which the toner image has been fixed by the fixing unit for each line, a setting unit configured to set a gloss addition area in the recording paper to which the gloss is added by the thermal head, a correction unit configured to correct the gloss addition area set by the setting unit so that numbers of heating units driven when the recording paper is heated by the thermal head are approximately equal in each line, and a control unit configured to control driving of the plurality of heating units based on the gloss addition area corrected by the correction unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
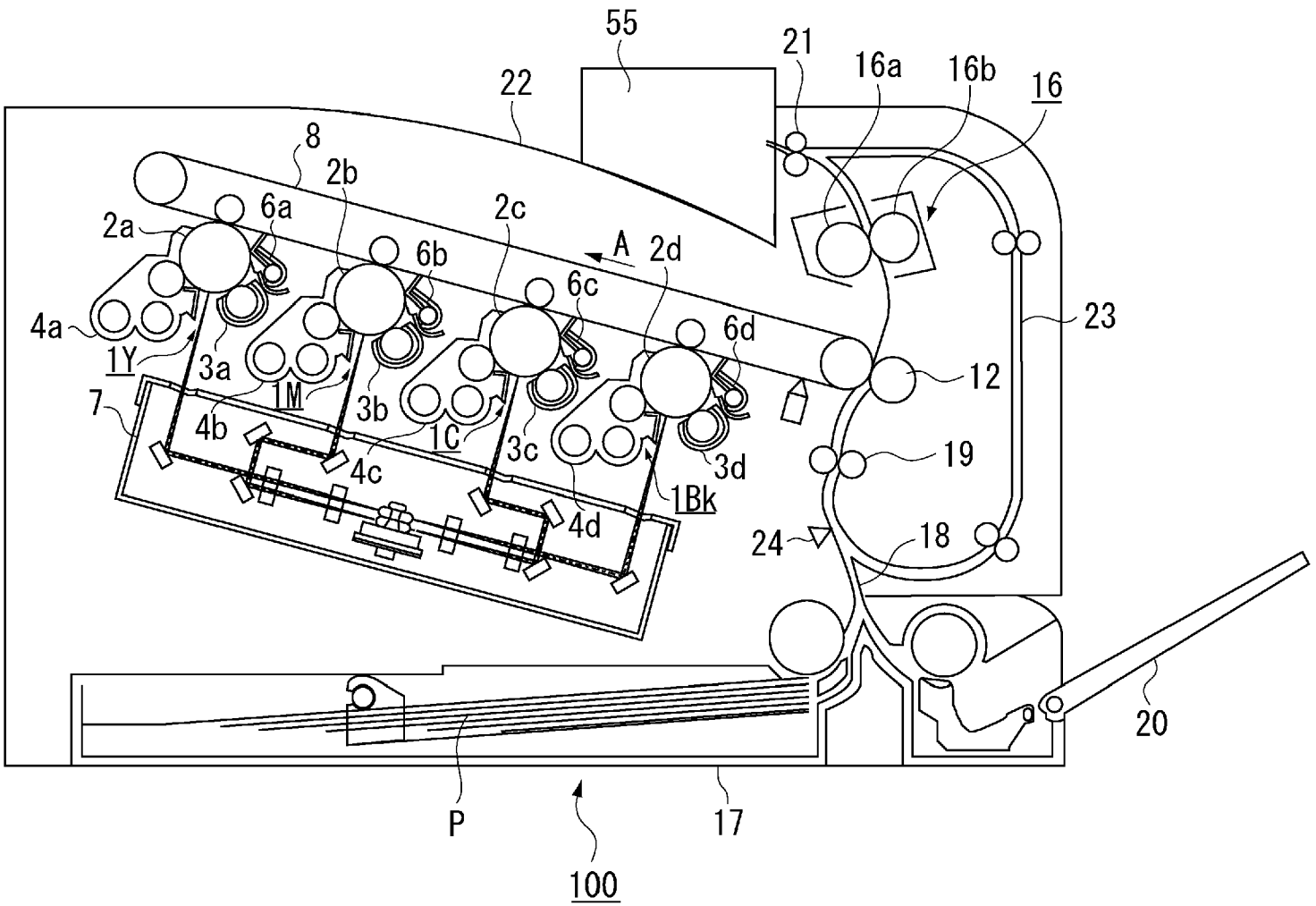
FIG. 1 is a cross sectional view of an image forming apparatus.

FIG. 1 is a cross sectional view of an image forming apparatus 100.

The image forming apparatus 100 includes four image forming units: an image forming unit 1Y that forms a yellow image, an image forming unit 1M that forms a magenta image, an image forming unit 1C that forms a cyan image, and an image forming unit 1Bk that forms a black image.

A laser scanner unit 7 is disposed below an intermediate transfer belt 8, which irradiates photosensitive members of respective colors 2*a* (yellow), 2*b* (magenta), 2*c* (cyan), and 2*d* (black) with laser beams modulated based on image data of the respective colors. Before irradiation with the laser beams, whole surfaces of the photosensitive members 2*a*, 2*b*, 2*c*, and 2*d* are charged by primary charging devices 3*a* (yellow), 3*b* (magenta), 3*c* (cyan), and 3*d* (black).

Each of developing devices 4*a*, 4*b*, 4*c*, and 4*d* electrostatically attaches toner of each color to the photosensitive member of each color irradiated with the laser beam by the laser scanner unit 7. The toner attached to the photosensitive member of each color is transferred to the intermediate transfer belt 8. The intermediate transfer belt 8 advances in a direction A illustrated, and a transferred toner image of each color is transferred again to recording paper P by a secondary transfer roller 12.

A paper feeding unit 17 and a manual multi-tray 20 are disposed further below. A conveyance path 18, a conveyance roller 19, and the secondary transfer roller 12 are vertically disposed with respect to the recording paper P. A fixing device 16 is disposed above the secondary transfer roller 12.

The fixing device 16 includes a fixing film 16*a* having a heat source such as a ceramic substrate printed with a heater-pattern, and a pressure roller 16*b* pressed to the substrate sandwiching the fixing film.

A fixing discharge roller 21 and a gloss addition apparatus 55 are disposed on a downstream side of the fixing device 16.

When images are formed on front and rear surfaces of the recording paper P, the fixing discharge roller 21 is reversely rotated to convey the recording paper P having an image formed and fixed on its one surface to a two-sided conveyance path 23. The recording paper P is fed again toward the secondary transfer roller 12 to form an image again on the rear surface of the recording paper P.

A recording paper sensor 24 detects the recording paper P fed from the paper feeding unit 17 or the manual multi-tray 20, and the recording paper P fed again from the two-sided conveyance path 23.

The gloss addition apparatus 55 heats an arbitrary area of the recording paper P again to add gloss. After completion of adding gloss to the recording paper P by the gloss addition apparatus 55, the recording paper P is discharged from the gloss addition apparatus 55 to a discharge tray 22.

Figure 2:
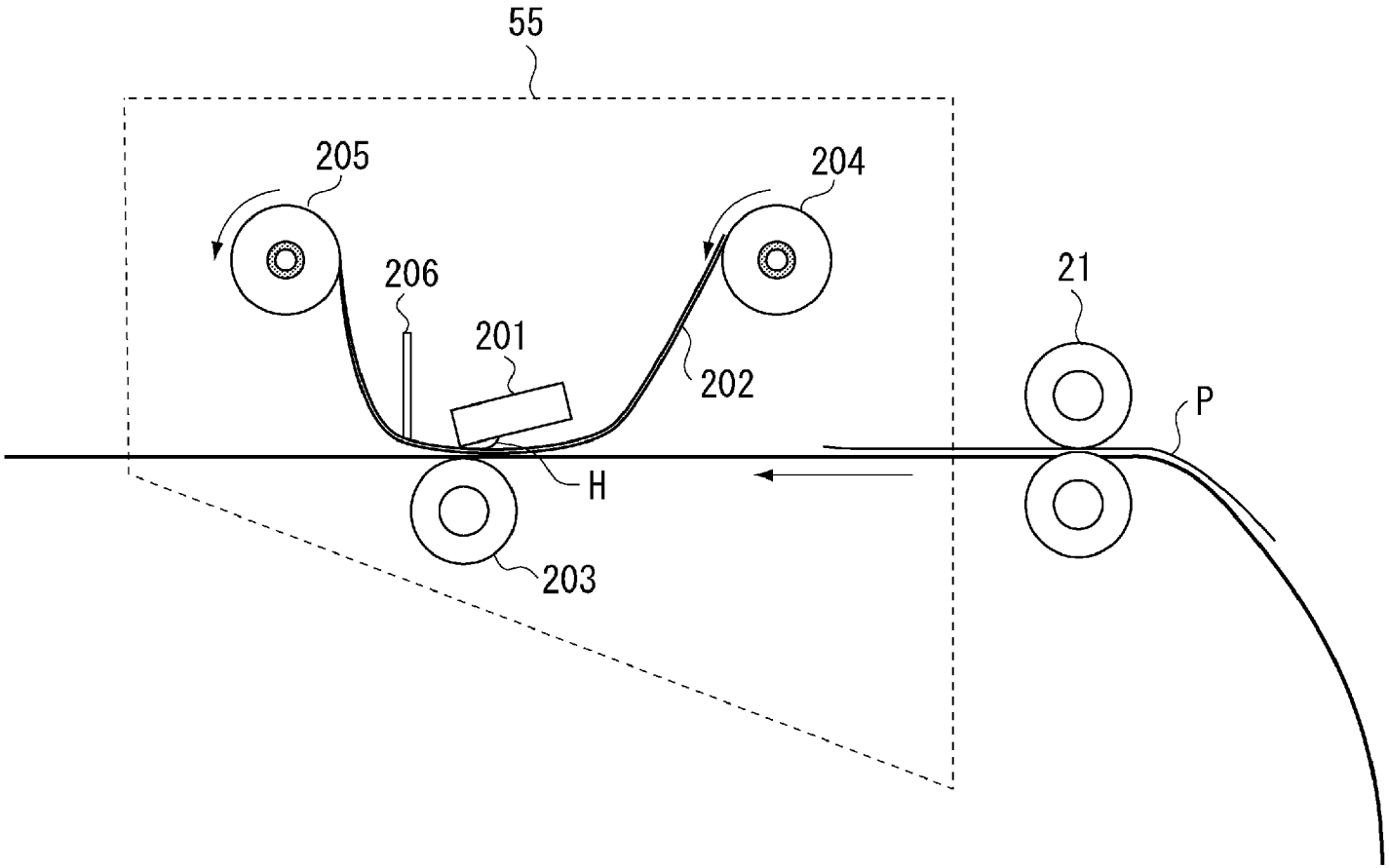
FIG. 2 is a cross sectional view of a gloss addition apparatus.

FIG. 2 is a cross sectional view of the gloss addition apparatus 55.

The fixing discharge roller 21 is located on the downstream side of the fixing device 16, and conveys the recording paper P discharged from the fixing device 16 to the gloss addition apparatus 55. A fixing discharge sensor (not shown) is located between the fixing device 16 and the fixing discharge roller 21, and detects a leading edge and a trailing edge of the recording paper P, and monitors the recording paper P to check that it is not retained in the fixing device 16.

Figure 3:
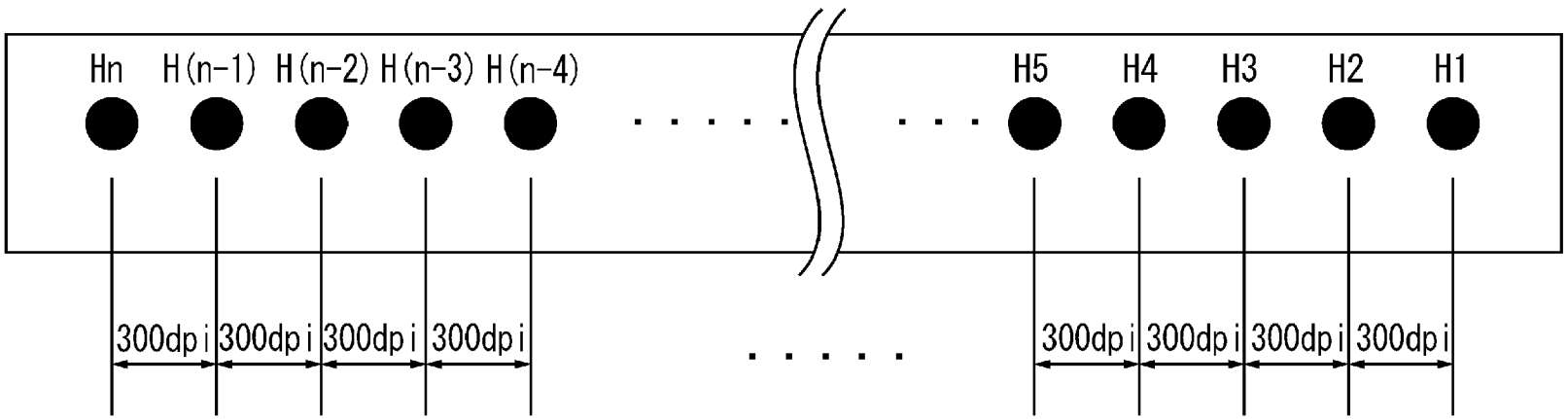
FIG. 3 illustrates a head layout of a thermal head.

The gloss addition apparatus 55 includes a thermal head 201. As illustrated in FIG. 3, the thermal head 201 includes n heating units (H1, H2, . . . , Hn) at its leading edge H. The plurality of heating units (H1, H2, . . . , Hn) are arrayed in line by about 5000 as much as a width of the recording paper P at an interval of 300 dots per inch (dpi).

A film 202 having a limited length is discharged from a discharge roller 204, and taken up by a take-up roller 205. A counter roller 203 facing the thermal head 201 conveys the recording paper P. A separation plate 206 functions to separate the recording paper P from the film 202.

The recording paper P conveyed in an arrow direction from the fixing discharge roller 21 passes through a nip portion formed by the film 202 and the counter roller 203. In this case, a toner image on the recording paper P is heated again only in an area where the thermal head is turned on, and an image to which gloss has been added is formed. The reheated recording paper P is discharged together with the film 202 in a left direction. The recording paper P is separated from the film 202 by the separation plate 206. While the film 202 is taken up by the take-up roller 205, only the recording paper P is discharged from the gloss addition apparatus 55.

Figure 4:
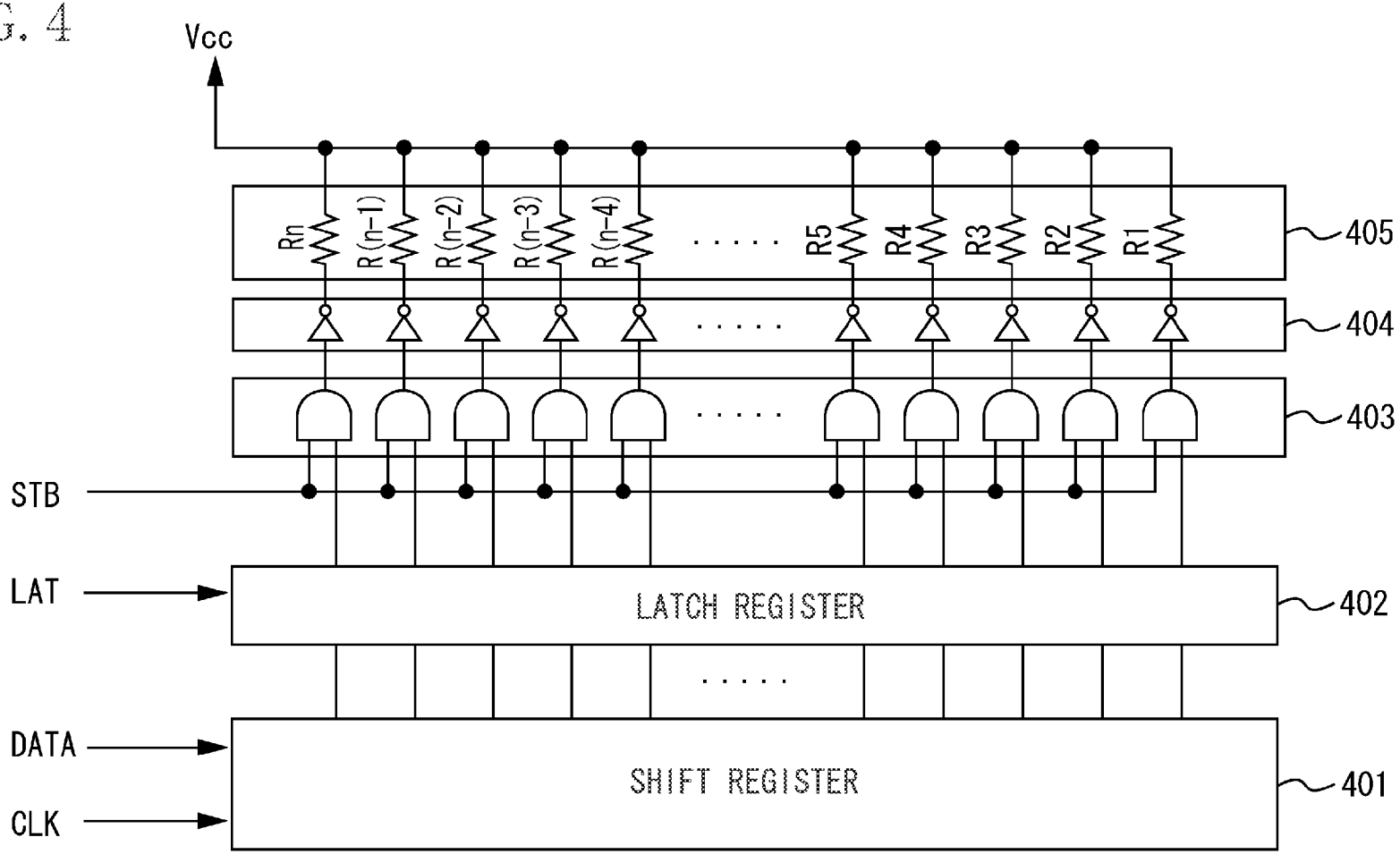
FIG. 4 is a block diagram illustrating an electric configuration of the thermal head.

FIG. 4 is a block diagram illustrating an electric configuration of the thermal head 201.

A shift register 401 stores DATA signals sequentially input from a central processing unit (CPU) 502 described below in synchronization with a CLK signal by as much as one line.

A latch register 402 latches data stored in the shift register 401 at timing of a LAT signal. The latched data becomes a driving signal used to drive the thermal head 201.

Agate circuit 403 outputs the driving signal latched by the latch register 402 when a STB signal is high. A driver element 404 drives the thermal head 201, and turns on the thermal head 201 when a high signal is input. A resistance heater 405 includes n resistors (R1, R2, . . . , Rn) disposed corresponding to the n heating units (H1, H2, . . . , Hn) of the thermal head 201.

Figure 5:
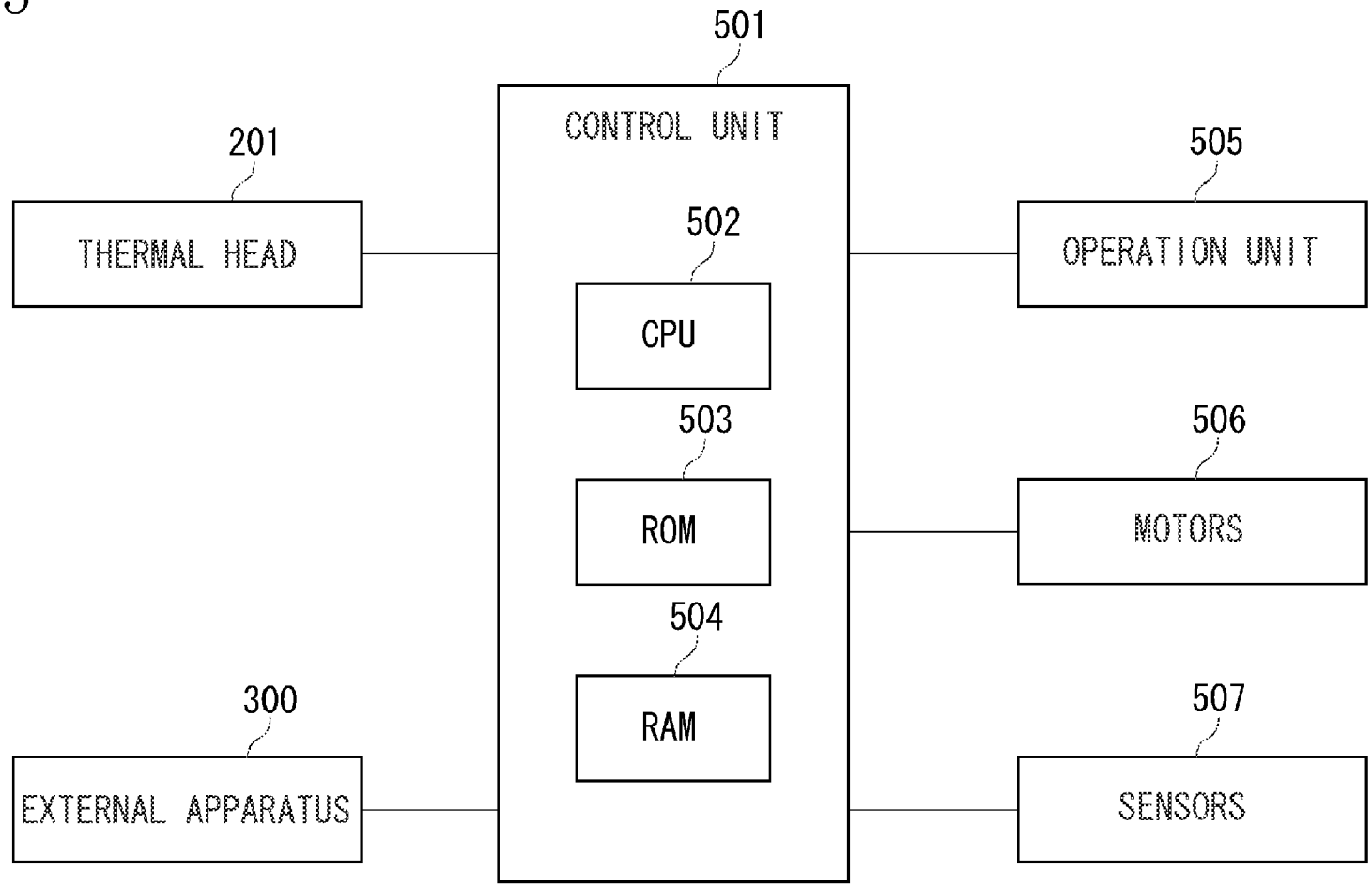
FIG. 5 illustrates a control block diagram of the image forming apparatus and the gloss addition apparatus.

FIG. 5 is a control block diagram illustrating the image forming apparatus 100 and the gloss addition apparatus 55.

A control unit 501 includes the CPU 502, a read-only memory (ROM) 503, and a random access memory (RAM) 504. The CPU 502 is a control circuit that controls the entire image forming apparatus 100. The ROM 503 stores a control program for controlling various processes executed in the image forming apparatus 100. The RAM 504 is a system work memory for the CPU 502 to operate, and functions as an image memory to temporarily store image data.

The CPU 502 receives image data from an external apparatus 300 such as an external scanner, a personal computer (PC) or a facsimile, and controls various motors 506 according to outputs from various sensors 507 disposed in the image forming apparatus 100 to form an image on the recording paper P. A user can instruct, by using an input key on an operation unit 505, the CPU 502 to switch displaying of a display unit.

Figure 6:
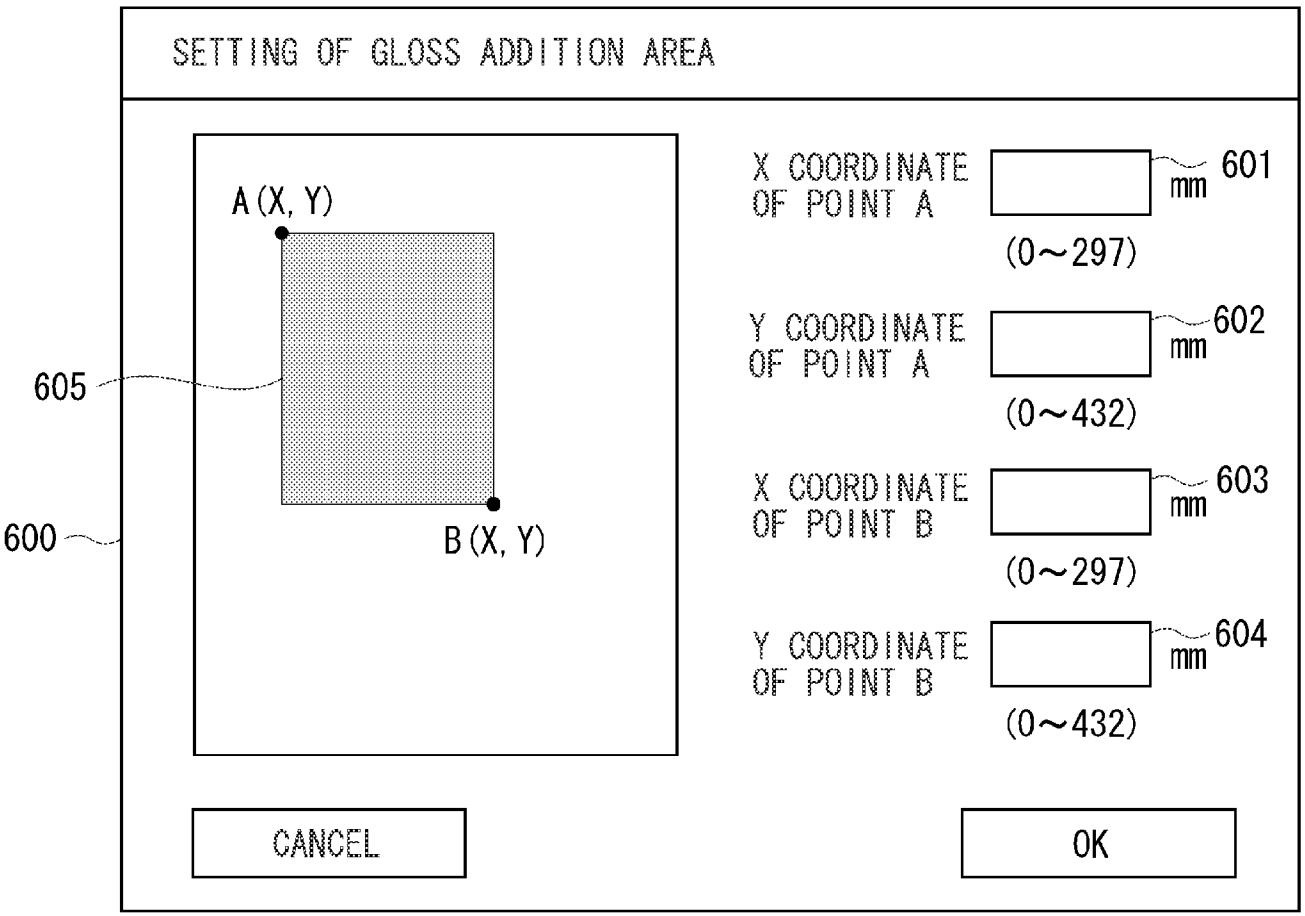
FIG. 6 illustrates a gloss addition area setting screen.

FIG. 6 illustrates a gloss addition area setting screen.

For example, in the case of image data where a photographic image and a text image are mixed in one page, the user may demand to add gloss to the photographic image area but not to the text image area. Thus, in the exemplary embodiment, the user can set a gloss addition area from the operation unit 505.

The display unit disposed in the operation unit 505 displays an image 600 to be output based on the image data received from the external apparatus. The user designates a gloss addition area 605 in the image 600 from the operation unit 505. Specifically, the user inputs an area to which gloss is added by inputting coordinates of two points of corners A and B of the gloss addition area 605 from coordinate input units 601 to 604.

As described above, the gloss addition area 605 is designated from the operation unit 505. However, the present invention is not limited to this configuration. For example, the user can input the gloss addition area 605 from the external apparatus 300 such as a scanner, a PC, or a facsimile, and transmit data indicating the input gloss addition area 605 to the image forming apparatus 100.

Figure 7A:
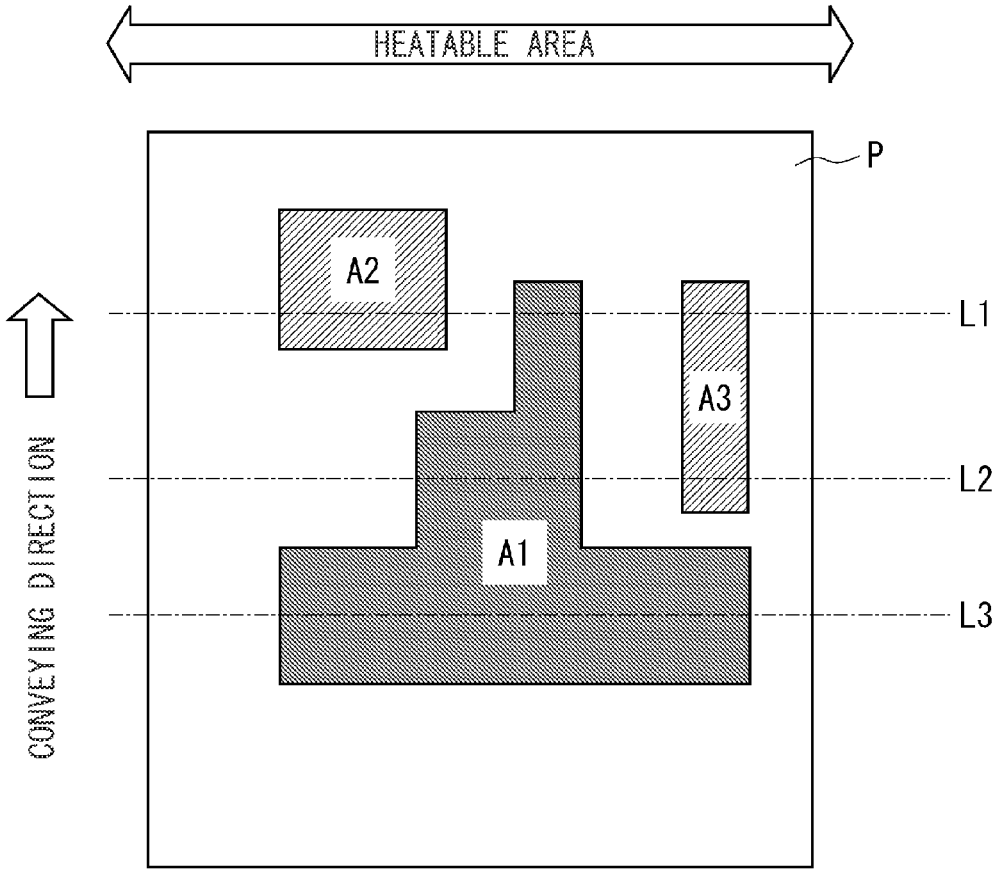
FIG. 7A illustrates an example of a gloss addition area.

FIG. 7A illustrates an example of a gloss addition area.

In the recording paper P, an area A1 is set as a gloss addition area, while areas A2 and A3 are toner image areas which is not set as gloss addition areas.

Figure 7B:
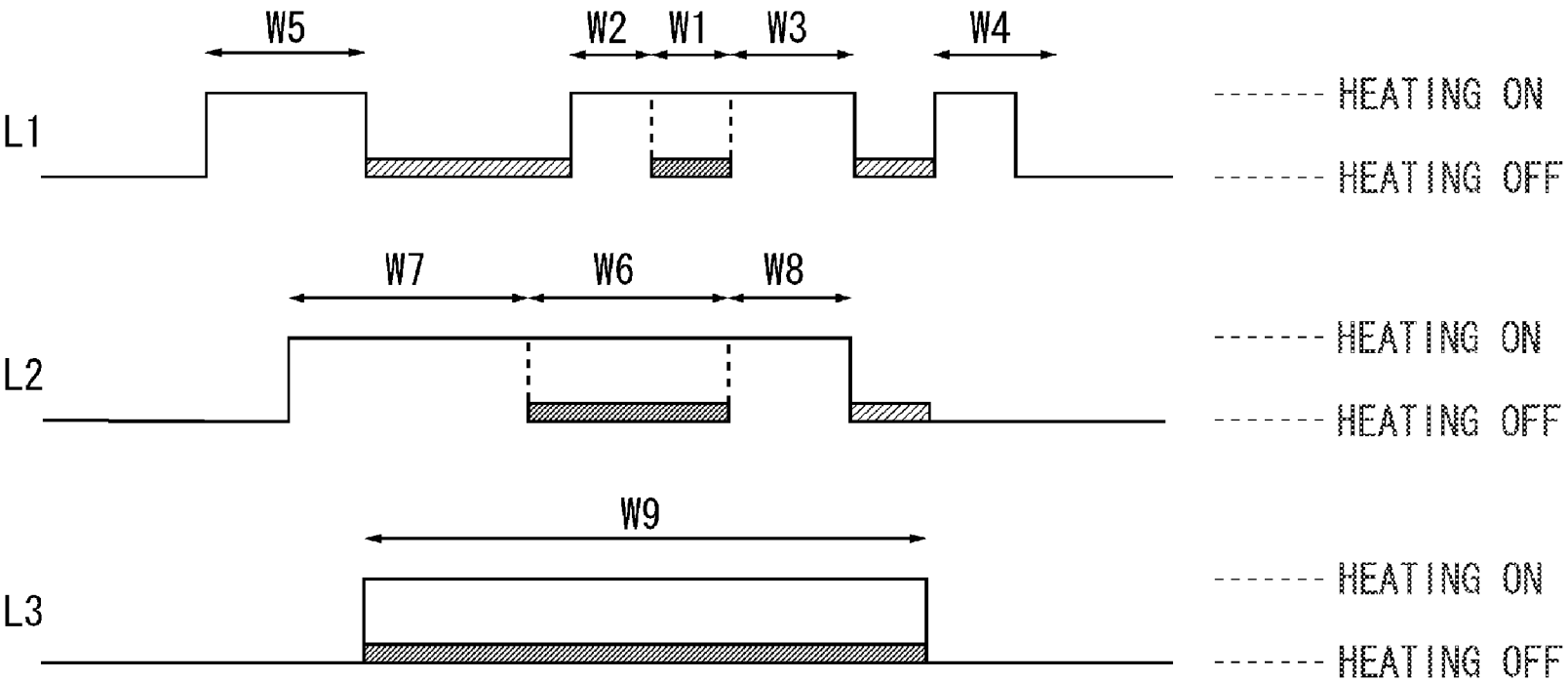
FIG. 7B illustrates a heating area of the thermal head.

As illustrated in FIG. 7A, in this example, when lines L1, L2, and L3 in a width direction orthogonal to a conveying direction of the recording paper P are compared with one another, a gloss addition area is largest at the line L3. As illustrated in FIG. 7B, the number of gloss addition dots at the line L3 is W9. In the area A1, a maximum width of heating the thermal head 201 is W9.

At the line L2, the number of gloss addition dots is W6, and hence a width is narrower than that of the gloss addition area at the line L3. When a difference is large in a number of gloss addition dots between the line L2 and the line L3, a voltage applied to the thermal head 201 suddenly fluctuates, causing a change in heat generation amount of the thermal head 201. The change in heat generation amount of the thermal head 201 leads to uneven brightness.

Thus, the number of gloss addition dots at the line L2 must be set equal to the number of gloss addition dots W9 at the line L3. Specifically, the toner image area A3 to which no gloss needs to be added exists on the right side of the gloss addition area A1 at the line L2, and hence a heating area is extended by as much as a width of W8 immediately before the area A3 on the right side of the area A1. At the line L2, a heating area is extended by as much as W7 on the left side of the area A1, and the total number of heating dots W6+W7+W8 of the thermal head 201 is set equal to W9.

At the line L1, a gloss addition area is narrower, i.e., W1, and the toner image areas A2 and A3 to which no gloss needs to be added exist on both left and right sides of the area A1. Similarly, at the line L1, processing similar to that at the line L2 is performed. More specifically, the heating area is extended even to the areas W2 to W5 including no toner image in addition to W1, and the total number of heating dots W1+W2+W3+W4+W5 of the thermal head 201 is set equal to W9.

There is no gloss addition area from the leading edge of the recording paper P to a leading edge of the gloss addition area A1 and from a trailing edge of the gloss addition area A1 to the trailing edge of the recording paper P. In these areas, the heating unit having the number of dots equal to W9 is driven in an area including no toner image.

Figure 8:
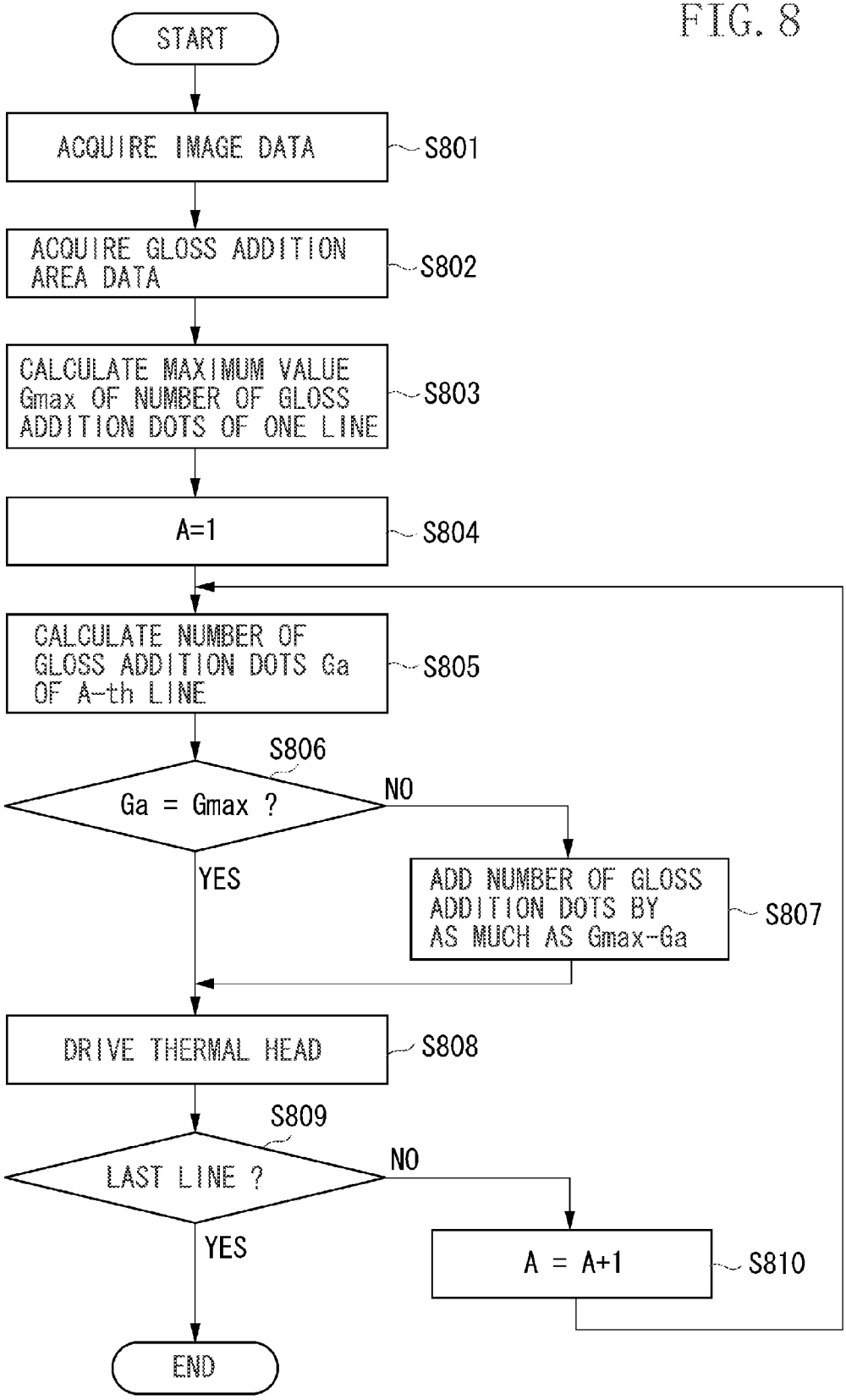
FIG. 8 is a flowchart illustrating an operation of adding gloss to recording paper.

FIG. 8 is a flowchart illustrating an operation of adding gloss to recording paper.

A program for executing the flowchart is stored in the ROM 503, and read by the CPU 502 to be executed.

In step S801, the CPU 502 receives image data from the external apparatus 300 such as a scanner, a PC or a facsimile to acquire the image data. In step S802, the CPU 502 acquires gloss addition area data input from the gloss addition area setting screen illustrated in FIG. 6 by the user.

In step S803, the CPU 502 calculates a maximum value Gmax of the number of gloss addition dots per line based on the acquired gloss addition area data. In the example of FIG. 7B, the number of gloss addition dots W9 of one line becomes a maximum value Gmax.

In step S804, the CPU 502 initializes, to perform a gloss adding operation, a variable A identifying a line in the image data to 1. In step S805, the CPU 502 calculates the number of gloss addition dots Ga of an A-th line. In the example of FIG. 7B, the number of gloss addition dots at the line L1 is W1, and the number of gloss addition dots at the line L2 is W6.

In step S806, the CPU 502 determines whether Ga is equal to Gmax (Ga=Gmax). In the case of Ga=Gmax (YES in step S806), the processing proceeds to step S808 without correcting a driving pattern of the thermal head 201.

In the case of Ga≠Gmax (NO in step S806), in step S807, the CPU 502 corrects the driving pattern of the thermal head 201 at the A-th line by adding the number of gloss addition dots as much as Gmax−Ga. More specifically, the CPU 502 corrects the gloss addition area so that the number of heating units of the driven thermal head 201 can be equal to the maximum value Gmax at each line. In the example of FIG. 7B, the numbers of gloss addition dots W2 to W5 are further added to the number of gloss addition dots W1 at the line L1, and the numbers of gloss addition dots W7 and W8 are further added to the number of gloss addition dots W6 at the line L2.

In step S808, the CPU 502 drives the thermal head 201 based on the driving pattern of the thermal head 201 of the A-th line to add gloss to the recording paper P. In step S809, the CPU 502 determines whether the A-th line is a last line in the image data. When the A-th line is a last line (YES in step S809), the CPU 502 finishes the processing flow.

When the A-th line is not a last line (NO in step S809), in step S810, the CPU 502 adds 1 to A. To perform a gloss adding operation at a next line, the processing returns to step S805.

The abovementioned control reduces fluctuation in a number of heating units driven when the recording paper P is heated by the thermal head 201. As a result, fluctuation in voltage applied to the thermal head can be suppressed, and uneven brightness on the recording paper can be prevented.

According to the exemplary embodiment, control is performed so that the numbers of heating units of the thermal head 201 driven for each line can be equal between the lines. In reality, however, the numbers of heating units do not need to be completely equal. In other words, similar effects can be achieved if a difference is set to a level where voltage fluctuation is negligible between numbers of gloss addition dots (numbers of heating units to be driven). Specifically, when fluctuation in a number of gloss addition dots is suppressed to within 10% at the maximum, voltage fluctuation can almost be ignored.

The exemplary embodiment has been described by way of example of a tandem type image forming apparatus as the image forming apparatus 100. However, the present invention is not limited to this configuration as long as the image forming apparatus is an electrophotographic image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-285754 filed Dec. 16, 2009, which is hereby incorporated by reference herein in its entirety.

What is claimed is:

1. An image forming apparatus comprising:

a paper feeding unit configured to feed recording paper;

a transfer unit configured to transfer a toner image to the recording paper fed by the paper feeding unit;

a fixing unit configured to fix the toner image transferred to the recording paper by the transfer unit on the recording paper;

a thermal head having a plurality of heating units arrayed in a width direction orthogonal to a conveying direction of the recording paper, and configured to add gloss by heating an arbitrary area of the recording paper on which the toner image has been fixed by the fixing unit for each line;

a setting unit configured to set a gloss addition area in the recording paper to which the gloss is added by the thermal head;

a correction unit configured to correct the gloss addition area set by the setting unit so that numbers of heating units driven when the recording paper is heated by the thermal head are approximately equal in each line of the image; and a control unit configured to control driving of the plurality of heating units based on the gloss addition area corrected by the correction unit.

2. The image forming apparatus according to claim 1, wherein the correction unit expands the gloss addition area to an area unset as the gloss addition area and having no toner image formed therein so that the numbers of heating units driven when the recording paper is heated by the thermal head are approximately equal in each line.

3. The image forming apparatus according to claim 1, wherein the correction unit calculates a maximum value of the number of heating units per line driven when the recording paper is heated by the thermal head, and corrects the gloss addition area set by the setting unit so that the number of heating units driven at each line is equal to the maximum value.

* * * * *